United States Patent [19]

Kaduk et al.

[11] 3,995,191

[45] Nov. 30, 1976

[54] REPROGRAPHIC FLUORESCENT LAMP HAVING IMPROVED REFLECTOR LAYER

[75] Inventors: Edward E. Kaduk, Lyndhurst; Edward E. Hammer, Mayfield Village, both of Ohio

[73] Assignee: General Electric Company, Schenectady, N.Y.

[22] Filed: Dec. 5, 1975

[21] Appl. No.: 638,189

[52] U.S. Cl. ..... 313/485; 313/113; 313/486; 313/489

[51] Int. Cl.[2] ..... N01J 1/62

[58] Field of Search ..... 313/113, 221, 486, 488, 313/489

[56] References Cited

UNITED STATES PATENTS

| | | | |
|---|---|---|---|
| 3,141,990 | 7/1964 | Ray | 313/486 |
| 3,379,917 | 4/1968 | Mehelly | 313/221 |
| 3,875,455 | 4/1975 | Kaduk | 313/489 |
| 3,886,396 | 5/1975 | Hammer | 313/489 |

*Primary Examiner*—R. V. Rolinec
*Assistant Examiner*—Michael J. Tokar
*Attorney, Agent, or Firm*—John F. McDevitt; Lawrence R. Kempton; Frank L. Neuhauser

[57] ABSTRACT

An improved reflector layer is provided utilizing a titanium dioxide ($TiO_2$) admixture containing up to approximately 15 percent by weight magnesia (MgO). Said reflector layer underlies the phosphor layer, and an aluminum oxide ($Al_2O_3$) layer can be deposited upon the phosphor layer.

6 Claims, 1 Drawing Figure

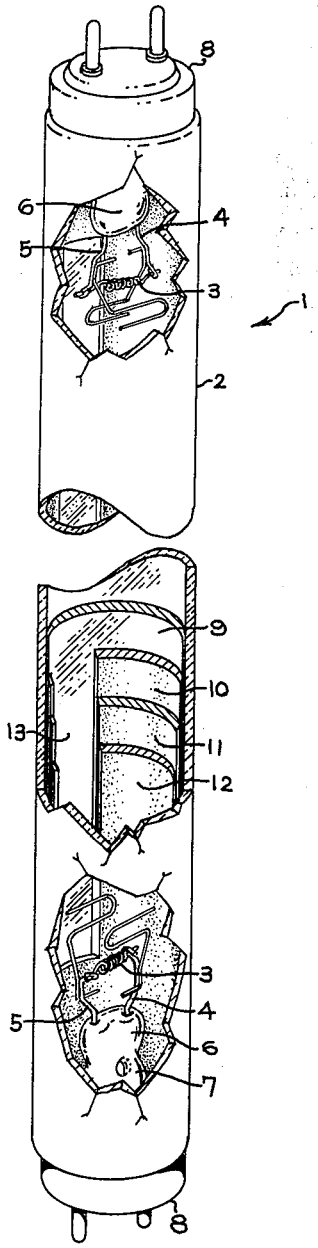
8
6
4
5
3
1
2
9
10
13
11
12
3
5
4
6
7
8

REPROGRAPHIC FLUORESCENT LAMP HAVING IMPROVED REFLECTOR LAYER

CROSS-REFERENCE TO RELATED APPLICATION

A related reflector layer is described in U.S. patent application Ser. No. 638,188, for Edward E. Hammer, entitled "Reprographic Fluorescent Lamp with Improved Reflector Layer," assigned to the present assignee and filed concurrently with the present application.

BACKGROUND OF THE INVENTION

The invention is in the general field of fluorescent lamps, particularly aperture-type fluorescent reprographic lamps used in copying documents and having a reflective coating of titanium dioxide disposed between the inner bulb wall and a phosphor layer for reflecting light outwardly through the aperture in addition to the light being emitted through the aperture directly from the phosphor layer. In one type of such aperture lamp, the aperture is in the form of an elongated region along at least a portion of the bulb length and is free from both phosphor and reflecting material and in another type the aperture is free from reflecting material but is covered with the phosphor. Such lamps are described in U.S. Pat. No. 3,875,455 which further describes the various different materials that can be used for the light reflector coating and for the phosphor composition. In more recently issued U.S. Pat. No. 3,886,396 it is disclosed that the reflected coating may consist entirely of magnesium oxide (MgO) and that a protective post-coating of finely divided aluminum oxide ($Al_2O_3$) particles deposited directly upon the phosphor layer improves lamp maintenance as well as reduces end discoloration during lamp operation.

Because of the decrease in light output which still occurs during lifetime of a reprographic lamp, there still remains a significant need for additional improvement. It would also be desirable to obtain improved lamp maintenance by simple modification of the reflector layer itself as distinct from any requirement for additional layers within the lamp envelope or accompanying modification of the phosphor layer from that presently used.

SUMMARY OF THE INVENTION

It has now been discovered, surprisingly, that a reflector layer which employs an admixture of $TiO_2$ and MgO in particular proportions provides higher light output and better lamp maintenance than is obtained with either material alone. While the reason for such combined improvement is not fully understood at present, it is contrary to what might be expected in one important respect. More particularly, MgO exhibits a lower reflectivity than $TiO_2$ when each material is used alone as the reflector coating. It is thereby unexpected that any improvement in light output should result from a partial replacement of $TiO_2$ with MgO and especially when the improved maintenance occurs with phosphor compositions previously regarded to have poor maintenance characteristics such as green zinc silicate.

Briefly, the present reflector layer comprises a $TiO_2$ admixture containing from a small but effective amount up to approximately 15 percent by weight MgO. Said admixture can be prepared in conventional fashion for coating of the inner bulb wall as a suspension in a solution of ethyl cellulose or some other suitable binder in an organic solvent. Thereafter the bulb can be lehred in order to volatilize the solvent and organic binder whereupon a solid adherent coating of said admixture is produced on the bulb wall. The phosphor layer can be directly deposited upon said reflector coating also in conventional fashion from a liquid suspension for subsequent lehring to provide the final composite coating. There remains only need to form the aperture window by conventional removal of some coating material.

In a preferred embodiment, an aluminum oxide post-coat is deposited directly upon a green zinc silicate phosphor layer as described in the aforementioned U.S. Pat. No. 3,886,396 to provide a three-layer coating which resists drop-off in light output during the life of the lamp. An especially preferred modification of said embodiment protects the inner glass surface of the lamp envelope with a thin clear film of titanium dioxide as disclosed in both aforementioned U.S. Pat. Nos. 3,875,455 and 3,886,396. To form this initial base coat layer, an organometallic compound of titanium such as tetrabutyl titanate or tetraisopropyl titanate dissolved in an appropriate solvent such as butyl alcohol or butyl acetate, is applied to the glass. The solvent evaporates almost upon application and the titanate is left deposited upon the inner surface of the glass bulb. Moisture from the air hydrolyzes the titanate almost as fast as the solvent evaporates forming titanium dioxide which remains as a very thin clear continuous protective film in a thickness from about 0.002 to 0.02 microns.

DESCRIPTION OF THE DRAWING

The accompanying drawing depicts an aperture fluorescent lamp in accordance with the present invention.

DESCRIPTION OF THE PREFERRED EMBODIMENT

Referring to the accompanying FIGURE, there is shown a fluorescent lamp 1 comprising an elongated soda lime silica glass tube or bulb 2 of circular cross section. It has the usual electrode 3 at each end supported on in-lead wires 4, 5 which extends through a glass press 6 in a mount stem 7 to the contacts of a base 8 affixed to the end of the lamp. The sealed tube is filled with an inert gas such as argon or a mixture of argon and neon at a lower pressure; for example, 2 torr, and a small quantity of mercury is added, at least enough to provide a low vapor pressure of about 6 microns during operation. The inner surface of the glass tube is first protectively coated with a thin liquid film of an organometallic compound of titanium which is deposited completely around the inner bulb circumference and thereafter lehred to produce a clear $TiO_2$ coating 9 that is bonded tightly to the glass surface. A reflector coating 10 is deposited thereon and a coextensive phosphor coating deposited upon said reflector coating with both coatings extending around the major portion of the glass tubes circumferential surface as shown. This leaves a narrow uncoated strip or aperture 13 extending lengthwise of the lamp. Alternately, the coatings 10 and 11 may be applied at first over the entire glass tube internal surface and then scraped or brushed off to form the aperture 13 in a desired width; for instance, over a 45° portion of the circumference of the tube. A post-coating 12 of finely divided alumina is then deposited as the topmost layer with said post-coat preferably extending over the clear aperture 13 in order to provide maximum protection of the underlying layers. In accordance with the present invention, the improved reflector layer 10 comprises a $TiO_2$ admixture containing from an effective amount up to approximately 15 percent by weight MgO and which can be prepared directly by introducing finely divided solid MgO into an otherwise conventional $TiO_2$ coating suspension. A suitable MgO preparation is described in the aforementioned U.S. Pat. No. 3,875,455 patent which produces approximately the same fine particle size as the $TiO_2$ particles in the preferred reflector coating. Said $TiO_2$ particle size in the reflector layer 10 is less than one micron diameter; for instance, an average particle size of approximately 0.3 microns, and this material is available commercially.

The phosphor material in layer 11 which is desirably protected with an alumina post-coating 12 is green zinc orthosilicate ($Zn_2SiO_4$) which can be applied from a suspension in a solution of nitrocellulose in butyl acetate, all in known manner. The preferred zinc orthosilicate phosphor also contains approximately 0.4 percent by weight $Sb_2O_5$. Examples of other phosphor materials which can be improved in accordance with the present invention include magnesium aluminum gallate or cool white halophosphate and still other phosphors are contemplated. Deposition of a suitable alumina post-coating 12 is also described in the aforementioned U.S. Pat. No. 3,886,396 patent along with a preferred method for preparing such coating suspension.

The improved performance of reprographic lamps made in accordance with the present invention is shown in the following tables which illustrate relative aperture brightness at various burning hours of lamp operation. These tests were conducted upon 18-inch long T8-type aperture lamps utilizing various phosphor coatings to evaluate the improvement in aperture brightness attributable to the present reflector layer. Reported aperture brightness measurements in said tables provide a comparison between a $TiO_2$ reflector layer containing no additives when compared with $TiO_2$ admixtures containing various amounts of MgO. In Table 1 below, it can be noted that a 0.05 percent by weight MgO addition in the $TiO_2$ reflecting layer produces higher initial aperture brightness when employed with both green zinc silicate and green magnesium gallate phosphor coatings as well as improved lamp maintenance after the lamps have been burned for 300 hours. As distinct therefrom, the same MgO addition when used with cool white halophosphate phosphor produced lower initial brightness but improved lamp maintenance during the same period of operation.

Table 1

| Phosphor | Reflector Layer | Light Output (Arbitrary Units) 2 Hrs. | 300 Hrs. |
|---|---|---|---|
| Green $Zn_2SiO_4$ | $TiO_2$ | 133.7 | 86.3 |
| | $TiO_2$ with 0.05% MgO | 137.6 | 97.2 |
| Green Mg-Al Gallate | $TiO_2$ | 82 | 69.2 |
| | $TiO_2$ with 0.05% MgO | 83.1 | 73.7 |
| Cool White Halophosphate | $TiO_2$ | 101.3 | 91.4 |
| | $TiO_2$ with 0.05% MgO | 99.2 | 93.1 |

In a different type comparison utilizing the same size reprographic lamp and green zinc silicate phosphor coating above employed various $TiO_2$ reflector layers were compared for light output and lamp maintenance. More particularly, a 5 percent by weight addition of MgO was compared with a $TiO_2$ reflector layer containing no additive and with a further comparison being conducted upon certain of said lamp embodiments which included an aluminum oxide post-coating being deposited on the phosphor coating. The results of the brightness measurements conducted upon said lamps are reported on the following page in Table 2, but no direct comparison should be made with the values reported in the preceding Table 1 since different measurement methods and lamp operation periods took place.

Table 2

| Reflector Layer | Light Output (Arbitrary Units) 1 Hr. | 100 Hrs. |
|---|---|---|
| $TiO_2$ | 105.0 | 71.0 |
| $TiO_2$ with 5% MgO | 100.0 | 73.0 |
| $TiO_2$ with 5% MgO and 0.5% $Al_2O_3$ | 104.0 | 74.5 |
| Reflector Layer and $Al_2O_3$ Post-coat | | |
| $TiO_2$ | 100.0 | 79.0 |
| $TiO_2$ with 5% MgO | 98.0 | 83.0 |
| $TiO_2$ with 5% MgO and 0.5% $Al_2O_3$ | 100.0 | 82.5 |

It can be noted from Table 2 that a 5 percent MgO addition improves lamp maintenance and with said improvement being greater when further utilizing an aluminum oxide post-coating in conjunction with the present reflector layers. A further improvement in higher initial brightness is produced from incorporation of 0.5 weight percent aluminum oxide in the present reflector layer admixtures.

It will be apparent from the above description that various modifications of the illustrated embodiments can be carried out without departing from the true spirit and scope of the present invention. For example, still other additives may be incorporated in the present MgO containing admixtures as a further means of providing increased lamp brightness and maintenance. It is intended to limit the present invention, therefore, only by the scope of the following claims.

What we claim as new and desire to secure by Letters Patent of the United States is:

1. An aperture fluorescent reprographic lamp comprising an elongated envelope containing an ionizable medium including mercury vapor and having electrodes at the respective ends thereof, and a phosphor layer deposited upon a reflector layer within said envelope, the improvement wherein said reflector layer comprises a $TiO_2$ admixture containing from a small but effective amount up to approximately 15 percent by weight MgO.

2. A lamp as in claim 1 wherein the phosphor composition is a green zinc silicate phosphor.

3. A lamp as in claim 2 wherein the phosphor composition is a green zinc silicate phosphor admixture containing up to approximately 0.4 percent by weight $Sb_2O_3$.

4. A lamp as in claim 1 wherein the phosphor composition is a green magnesium gallate phosphor.

5. A lamp as in claim 1 wherein the phosphor composition is a cool white halophosphate phosphor.

6. A lamp as in claim 1 which further includes an aluminum oxide layer deposited upon the phosphor layer.

* * * * *